US006987235B2

(12) United States Patent
Sambar et al.

(10) Patent No.: US 6,987,235 B2
(45) Date of Patent: Jan. 17, 2006

(54) REDUNDANT SWITCH HAVING TORSIONAL COMPLIANCE AND ARC-ABSORBANT THERMAL MASS

(75) Inventors: Homer S. Sambar, Shorewood, WI (US); Jeffrey R. Annis, Waukesha, WI (US); Roy A. Rice, Cudahy, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 75 days.

(21) Appl. No.: 10/455,875

(22) Filed: Jun. 6, 2003

(65) Prior Publication Data

US 2004/0245083 A1 Dec. 9, 2004

(51) Int. Cl.
*H01H 13/14* (2006.01)

(52) U.S. Cl. ..... 200/520; 200/330

(58) Field of Classification Search ..... 200/293–296, 200/18, 341, 329, 330, 332.1, 318.1, 321, 200/307, 50.02, 43.07, 16 R, 16 C, 17 R, 200/43.01, 43.04, 50.01, 50.06

See application file for complete search history.

(56) References Cited

U.S. PATENT DOCUMENTS

| | | | | |
|---|---|---|---|---|
| 4,249,057 A | * | 2/1981 | Schlegel et al. | 200/296 |
| 5,045,655 A | * | 9/1991 | Ludwig et al. | 200/296 |
| 5,744,766 A | | 4/1998 | Sambar et al. | |
| 6,198,058 B1 | * | 3/2001 | Graninger et al. | 200/50.02 |
| 6,376,785 B1 | | 4/2002 | Graninger | |

FOREIGN PATENT DOCUMENTS

| | | |
|---|---|---|
| FR | 1 443 954 A | 7/1965 |
| GB | 1 080 279 | 8/1967 |
| GB | 1 204 398 | 9/1970 |

* cited by examiner

*Primary Examiner*—Elvin Enad
*Assistant Examiner*—Lisa Klaus
(74) *Attorney, Agent, or Firm*—Quarles & Brady LLP; Alexander M. Gerasimow

(57) ABSTRACT

A switch is provided that is of the type that may be installed in a contact block engaging a pushbutton operator via a latch assembly. The switch includes a spanner that engages a pair of terminals, each having a pair of contacts. The outer ends of the spanner are wider than the central portion so as to render the spanner torsionally compliant. The wide outer ends provide a sufficient thermal mass to absorb an arc that may be created when the switch is opened.

20 Claims, 6 Drawing Sheets

REDUNDANT SWITCH HAVING TORSIONAL COMPLIANCE AND ARC-ABSORBANT THERMAL MASS

CROSS REFERENCES TO RELATED APPLICATIONS

NOT APPLICABLE

STATEMENT REGARDING FEDERALLY SPONSORED RESEARCH

NOT APPLICABLE

BACKGROUND OF THE INVENTION

The invention relates to switch assemblies, and in particular relates to a reliable contact block with a double break spanner.

Electrical switches, such as pushbuttons or rotary switches, and the like, used for the control of industrial equipment, are typically mounted onto a front panel of a cabinet so that the manipulated portion of the switch (termed the "pushbutton operator") projects out from and is accessible at the front of the cabinet.

For a pushbutton switch, a hole of sufficient diameter may be punched in the cabinet to accommodate the threaded portion of the operator The threaded portion is inserted through the hole, and secured to the panel with a threaded retaining nut. The panel is thus sandwiched between the operator and the retaining nut.

A latch assembly is mounted on the end of the operator protruding inside the panel and a contact block or a plurality of contact blocks are mounted onto the other side of the latch assembly. The contact blocks are electrically connected to the circuit or circuits that the switch is to control.

Contact blocks typically include housings that contain normally open and/or normally closed contacts. A normally open contact may be used, for example, when a user wishes to activate a specified function by actuating the operator, thereby closing the normally open contact. When the operator switch is deactivated, a plunger returns to its normal position, thereby opening the normally open contact and terminating the controlled function.

A normally closed contact may be used when a user wishes to stop an ongoing function. One common example of a normally closed contact is an Emergency Stop (E-Stop) function which is activated when the user wishes to immediately terminate the controlled function due, e.g., to a malfunction in the process or the development of a situation that may cause damage to the product line or the operating equipment. In this situation, when the switch operator is actuated, the normally closed contact opens and remains open until the operator is returned to its normal state, thereby closing the normally closed contact and resuming the controlled function.

Referring to FIG. 1, a conventional switch 20 is illustrated including a spanner 21 that is disposed above a pair of contact plates 24. Spanner 21 is a double break spanner, meaning that both outer ends 22 engage a contact plate 24 such that the circuit is broken if either outer end becomes disengaged from the corresponding contact plate. In particular, each contact plate is aligned with an outer end 22 of spanner 21. Spanner 21 and contact plates 24 are of the type that are installed into a contact block (not shown) in the general orientation illustrated. A switch operator of a pushbutton, for instance, may be depressed (in a normally open switch) to bias spanner 21 downwardly along the direction of Arrow A until the outer ends 22 engage the corresponding contact plates 24 to operate a controlled function. A contact 26 is in the form of a conductive nub that protrudes upwardly from each contact plate 24 and towards a corresponding outer end 22 to provide a contact location between the spanner 21 and contact plates 24 when the switch 20 is closed. The pushbutton is released to allow the spanner 21 to translate upwardly away from contact plates 24 under a spring force along the direction of Arrow B to disengage the outer ends 22 from the contact plates 24 when operation of the controlled function is to be discontinued. It has been recognized, however, that the accumulation of a nonconductive mass (such as dirt, dust and the like) may become lodged between the contact 26 and outer ends of spanner 22, which prevents current from flowing through the closed switch 20. Electrical conduction between contact plates 24 was thus not reliably established in conventional switch 20.

Referring now to FIG. 2, a conventional switch 28 addresses the potential presence of nonconductive masses that could compromise the reliability of switch 20 illustrated in FIG. 1. In particular, switch 28 includes a spanner 30 having a slot 32 extending longitudinally partially through each outer end 34 to produce a pair of bifurcated fingers 36*a* and 36*b* at each end. Each finger 36 is independently vertically flexible with respect to the spanner 30 and therefore provides a redundant contact that engages a flat contact plate 38. A contact (not shown) protrudes downwardly from the lower surface of each finger 36 towards the contact plate 38. Accordingly, if a nonconductive mass were to become lodged between one of the contacts (e.g., of a finger 36*a*) and contact plate 38 to prevent the corresponding finger 36*a* from making electrical contact with the plate, the contact corresponding to the adjacent finger 36*b* would still engage the contact plate 38 to enable current to flow through spanner 30. Unfortunately, when switch 28 is opened, an electrical arc is often created between the contact plate 38 and the last finger 36 to disconnect from the plate 38. Because the bifurcated fingers 36 have a reduced mass with respect to the outer end 34, the fingers tend to melt or otherwise fail in response to the heat produced by the arc.

What is therefore needed is a switch usable in a contact block that provides redundancy without compromising the structural integrity of the switch components during use.

BRIEF SUMMARY OF THE INVENTION

In one aspect, a switch is provided that is of the type that may be installed in a contact block engaging a pushbutton operator via a latch assembly. The switch includes a contact defining a first and second end. The first end is connected to an external device controlled by the switch. A first and second nub extends outwardly from the second end. A laterally extending conductive spanner has a body connected to an outer end that is aligned with the first and second nubs of each second end, respectively. A circuit is formed when the spanner is electrically connected to the second end. The outer ends of the spanner are wider than the central portion so as to render the spanner torsionally compliant.

These and other aspects of the invention are not intended to define the scope of the invention for which purpose claims are provided. In the following description, reference is made to the accompanying drawings, which form a part hereof, and in which there is shown by way of illustration and not limitation a preferred embodiment of the invention. Such embodiment does not define the scope of the invention and reference must therefore be made to the claims for this purpose.

BRIEF DESCRIPTION OF THE DRAWINGS

Preferred exemplary embodiments of the invention are illustrated in the accompanying drawings in which like reference numerals correspond to like elements throughout, and in which.

DETAILED DESCRIPTION OF THE PREFERRED EMBODIMENT

Figure 3:
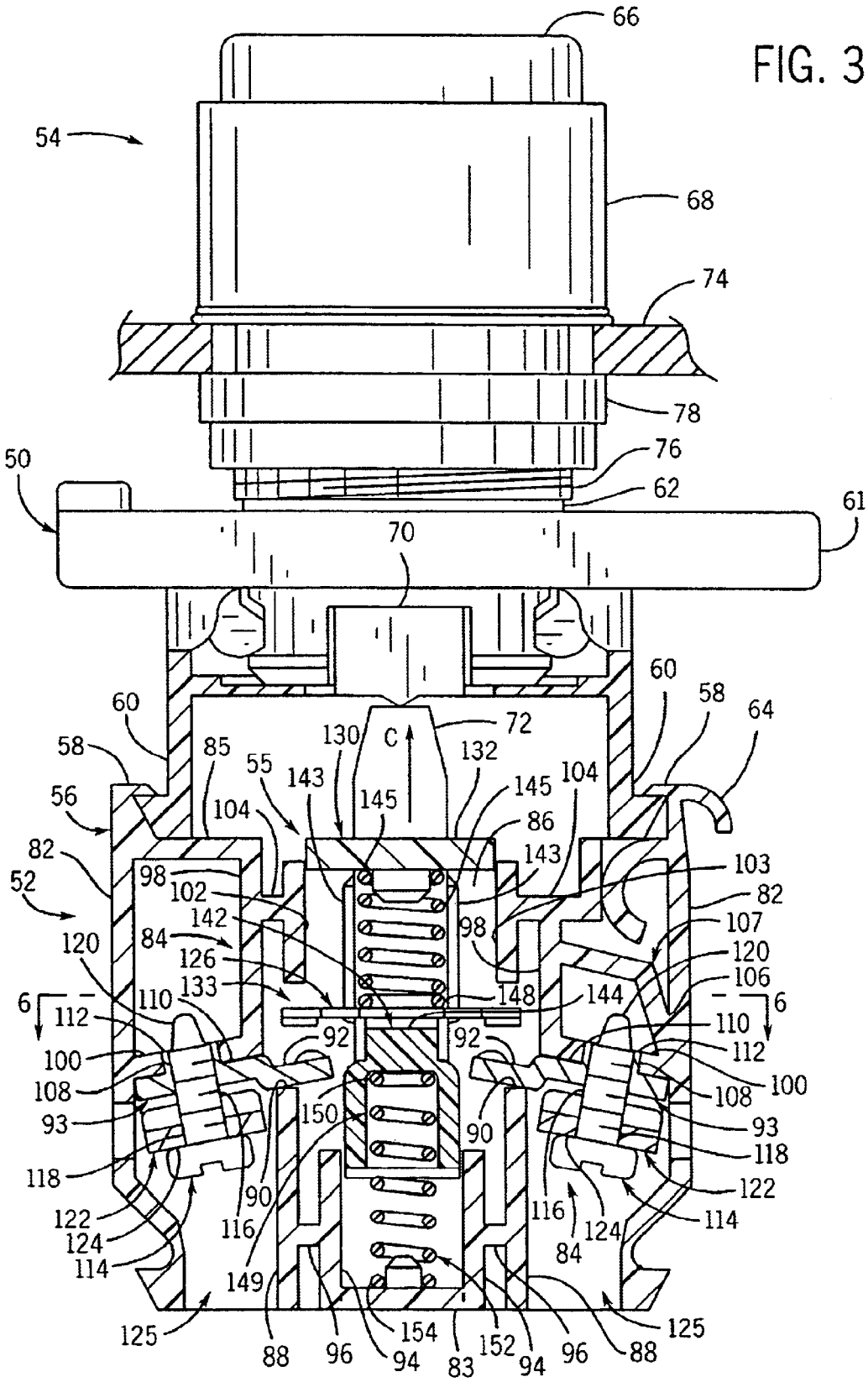
FIG. 3 is a side elevation view of a switch assembly constructed in accordance with the preferred embodiment having a portion of the control block cutaway, wherein the control block is in an open position.
Figure 6:
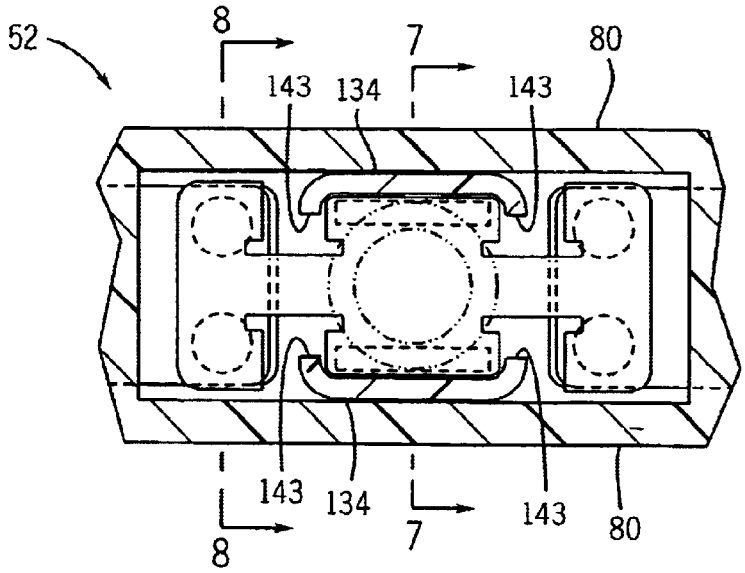
FIG. 6 is a sectional side elevation view of the contact block taken along line 6—6 of FIG. 3.

Referring to FIGS. 3 and 6, a contact block 52 is removably connected to a switch operator 54 via a latch assembly 50. In particular, contact block 52 includes a generally rectangular housing 56 that is connected to a pair of upper flanges 58 that extend upwardly and inwardly from the housing to provide a catch that engages mating flanges 60 extending downwardly from the latch assembly 50. Latch assembly 50 includes a rotatable collar 61 that removably engages the cylindrical shaft 62 of a switch operator 54 to the latch assembly 50. One example of such a latch assembly is described in U.S. Pat. No. 6,376,785 entitled "Removable Latch Assembly for an Electrical Switch", the disclosure of which is hereby incorporated by reference as if set forth in its entirety herein. A release tab 64 extends outwardly from one of the flanges 58 that is configured to engage the head of a screwdriver, for instance, when it is desired to pull flange 58 out of engagement from flange 60 to disconnect contact block 52 from latch assembly 50.

Switch operator 54 includes a pushbutton 66 located at a head 68 at one end of cylindrical shaft 62. The pushbutton 66 is attached to a stem 70 that extends axially through the shaft 62 to communicate the action of the pushbutton 66 to a plunger 72 in the contact block 52. A sheet panel 74, preferably made of sheet metal, has a hold (not shown) that receives the shaft 62, such that pushbutton 66 extends from the outer surface of panel 74, and the contact block 52 extends inwardly from the inner surface of a panel 74. External threads 76 are formed on the portion of the shaft 62 passing through the hole in panel 74. The head 68, remaining on the outside of the panel 74 when the shaft 62 is inserted into the hole, is drawn against the panel by a retaining nut 78, placed over the shaft inside of the panel, and tightened on the threads 76. The panel is thus sandwiched between the nut 78 and an inner face of the head 68.

While pushbutton 66 and latch assembly 50 have been described, it should be noted that any suitable apparatus for connecting the switch operator 54 to a contact block 52 may be used such that actuation of the switch operator in turn actuates the contact block plunger.

Housing 56 of contact block 52 retains a switch assembly 55 that is in a normally open position. Housing 56 includes opposing front and rear walls 80 that are connected at their outer ends to side walls 82. Walls 80 and 82 are connected at their lower ends to a base 83, and are connected at their upper ends to an upper wall 85. A pair of contact assemblies 84 is formed at each lateral end of walls 80 and are separated by a centrally disposed axially extending column 86 that comprises a void disposed between walls 80 of adjacent contact assemblies 84.

It should be appreciated that the term "axially" is used herein synonymously with "vertical" and defines a direction between contact block 52 and pushbutton 66. The term "laterally" is used herein to define a direction extending perpendicular to side walls 82. The term "transverse" is used herein to define a direction extending perpendicular to front and rear walls 80. These directional terms are used for the purposes of clarity and convenience, however the components of the present invention are not to be construed as limited to these directions.

Each contact assembly 84 includes a lower retaining wall 88 that extends upwardly from base 83 parallel to side walls 82 at a distance inwardly of side walls 82. The upper end 90 of each retaining wall 88 provides a seat for the inner end 92 of an electrically conducting plate 93. A pair of corresponding lower guide walls 94 extends upwardly from base 83 a distance less than lower retaining wall 88, and is connected to the adjacent lower retaining wall 88 via a crossbar 96 to ensure structural integrity.

A pair of upper retaining walls 98 extends downwardly from upper wall 85 parallel to side walls 82 at a distance inwardly of side walls 82. The lower end of each upper retaining wall 98 is connected to a mounting wall 100 that extends laterally outwardly to the corresponding side wall 82. A pair of corresponding upper guide walls 102 extends downwardly from upper wall 85 a distance less than upper retaining walls 98, and is connected to the adjacent upper retaining wall 98 via a crossbar 104 to ensure structural integrity.

An angled wall 107 is connected to the interface 106 of mounting wall 100 and one of the side walls 82. Wall 107 extends generally upwardly and then generally inwardly and is connected to the upper end of corresponding upper retaining wall 98 to provide structural support for release tab 64. In particular, the interface 106 provides a hinge that enables the corresponding side wall 82 to flex outwardly in when release tab 64 is engaged.

Each mounting wall 100 defines an aperture 108 extending through the wall 100 in a direction perpendicular to the wall 100. Each electrically conducting plate 93 defines an outer end 110 that extends along the bottom surface of mounting wall 100. A cylindrical flange 112 extends generally upwardly from outer end 110 and into aperture 108. Flange 112 defines an internally threaded bore. Flange 112 receives a screw 114 having a middle threaded portion 116, a lower threaded portion 120 proximal the screw tip, and an upper threaded portion 118 proximal the screw head.

A V-shaped conducting electrical connector 122 includes first and second walls 124 joined at an apex whose concave surface faces plate 93. Apex 124 receives the upper unthreaded portion 118 of screw 114, which has a smaller diameter than the outer diameter of threads 116. Flange 112 receives the threaded portion 116, such that the lower unthreaded portion 120 extends beyond flange 112. Screw 114 may be rotated clockwise to tighten connector 122 against plate 93, or counterclockwise to translate connector 122 away from plate 93. An electrical lead is placed between each connector 122 and plate 93 prior to tightening the respective connector against the plate. Connector 122 is sized too large to fit through a gap 125 disposed between the lower end of side wall 82 and lower retaining wall 88. Unthreaded portions 120 and 118 are spaced apart a sufficient distance such that, when screw 114 is rotated counterclockwise until threads 116 become disengaged from flange 112, connector 122 is disposed above gap 125. The mechanical interference between threads 116 and connector 122 coupled with the interference between connector and gap 125 prevents the screw 114 from being completely removed from contact block 52.

Column 86 is occupied by a housing 130 that carries an electrically conducting laterally extending spanner 126 that, in combination with inner ends 92 of plates 93, provides a normally open switch 133. Specifically, referring also to FIG. 4, spanner 126 defines lateral outer ends 127 having corresponding lower surfaces 129 that engage the upper surfaces 95 of inner ends 92. A pair of domed conductive nubs (electrical contacts) 99 and 101 protrude upwardly from ends 92 and are transversely aligned to provide redundant contact points for spanner 126. Nubs 99 and 101 are preferably formed integrally with ends 92. Spanner 126 is generally made of copper, however, the lower surfaces 129 of outer ends 127 include a silver coating 131 to increase the electrical contact with nubs 99 and 101. Silver has been found to conduct electricity sufficiently so as to assist in heat dissipation at the outer ends 127 of the spanner, for example when an arc is present. It should be appreciated, however, that spanner 126 could be made of any suitable conductor, and that the outer ends may be coated with any suitable conductor or, alternatively still, the coating 131 may be eliminated. If coating 131 is present, then outer ends 127 have a greater vertical thickness than the remainder of spanner 126. Spanner 126 advantageously is torsionally compliant, as is described in more detail below.

Plunger 72 extends upwardly from the upper wall 132 of housing 130. A pair of opposing side walls 134 have corresponding proximal ends 136 that are connected to the transverse outer edges 138 of wall 132 (See also FIG. 10). Side walls 134 extend downwardly from upper wall 132 and terminate at distal ends 140. The distal ends 140 retain a plug 142, which may be snap-fit between walls 134. Distal ends 140 of walls 134 extend downwardly a slight distance past plug 142, and are separated from each other a distance slightly greater than the transverse thickness of base 83 to enable contact blocks 52 to be vertically stacked, as will be described in more detail below.

The upper surface 144 of plug 142 provides a seat for spanner 126. The lateral outer ends of each wall 134 are flared inwardly towards the opposing wall 134 to define flanges 143. Flanges 143 provide a guide for an upper spring 145 that is disposed in housing 130 such that the upper end 146 of spring 145 rests against the lower surface of upper wall 132, and the lower end 148 of spring 145 biases spanner 126 against the upper surface 144 of plug 142. A bore 149 extends axially upwardly through the lower surface 146 of plug 142. Bore 149 extends towards, but not all the way to, the upper surface 144. Bore 149 is sized to receive the upper end 150 of a lower spring 152 whose lower end 154 is in contact with base 83 of contact block housing 56. Lower spring 152 thus biases housing 130 upwardly such that plunger 72 engages the lower end of stem 70 and spanner 126 is disengaged from plates 93 when contact block 52 and operator 54 are initially installed in latch 50.

Figure 5:
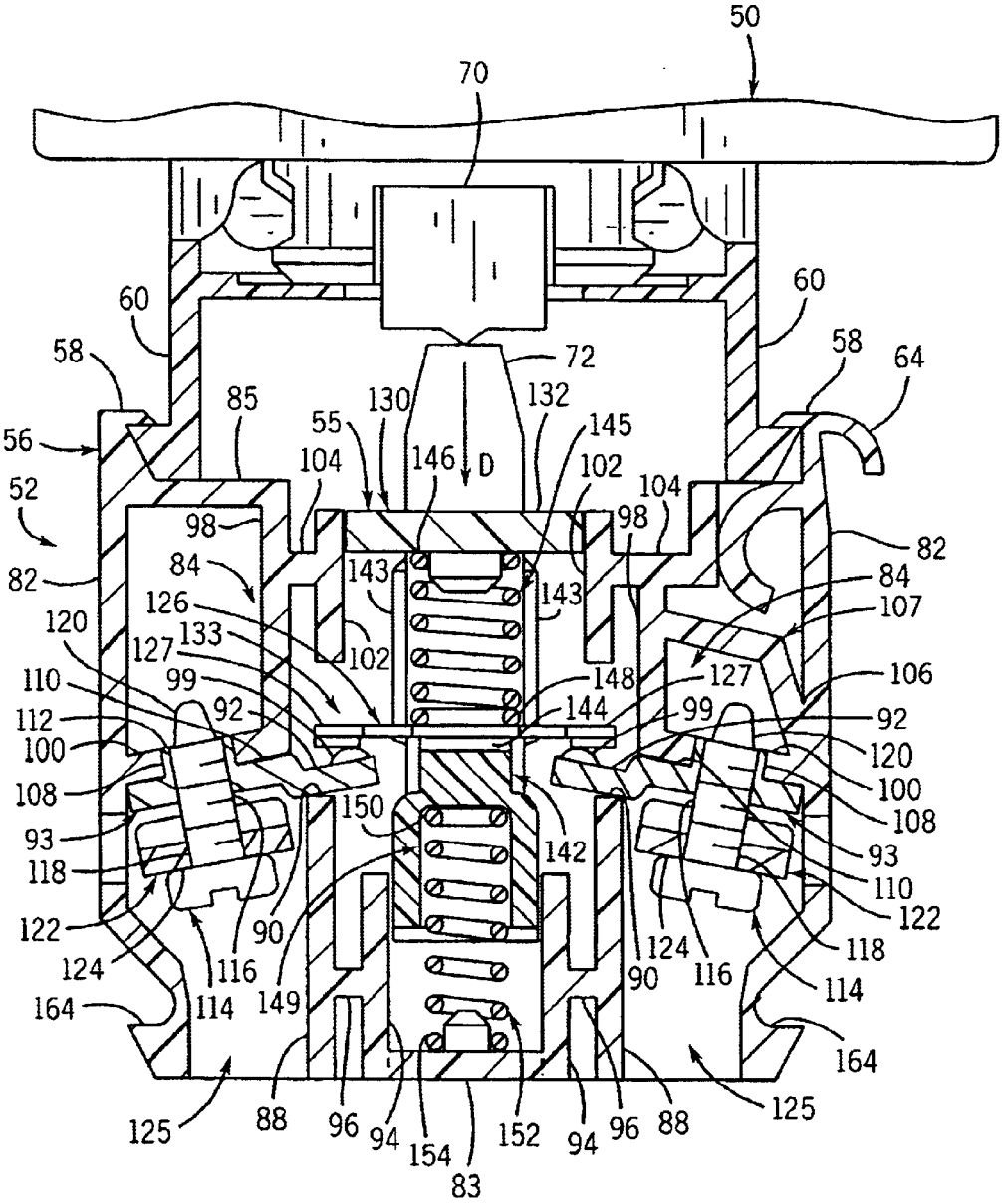
FIG. 5 is a side elevation view similar to FIG. 3 but with the contact block in a closed position.

Referring now also to FIG. 5, during operation, electrical leads that form a circuit to control a function of an external device (such as power or a control operation) are connected to contact block 52 via screws 114 and connectors 122. Housing 130 is then installed in column 86 such that spanner 126 is in a normally open configuration relative to plates 93. Control block 52 is connected to latch 50 via tabs 58, and operator 54 is connected to latch 50 in any known manner. When pushbutton 66 is depressed, stem 70 depresses plunger, which translates housing 130 downwardly along the direction of Arrow D against the force of lower spring 152.

Spanner 126, which is carried by the housing 130, is thus also biased downwardly until outer ends 127 engage the inner ends 92 of plates 93. Advantageously, upper spring 145 provides compliance such that housing 130 may continue to be biased downwardly against the force of upper spring 145, which compresses after spanner 126 engages plates 93. Spring 145 thus provides a force that biases spanner 126 against plates 93. The biasing force of spring 145 increases as housing 126 is increasingly depressed. The downward movement of housing 126 is limited by the stroke length of pushbutton 66, or by interference between the lower surface 146 of plug 142 and base 83.

Figure 1:
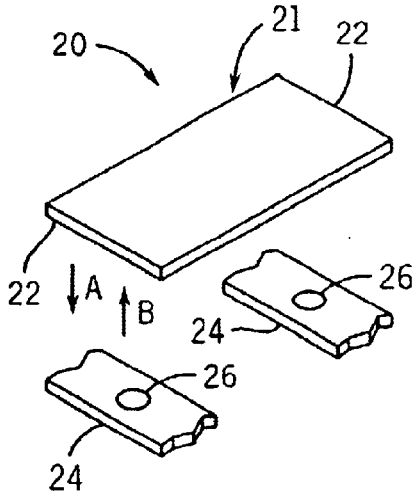
FIG. 1 (PRIOR ART)
FIG. 1 is a perspective view of the spanner portion of a control block constructed in accordance with the conventional techniques.
Figure 2:
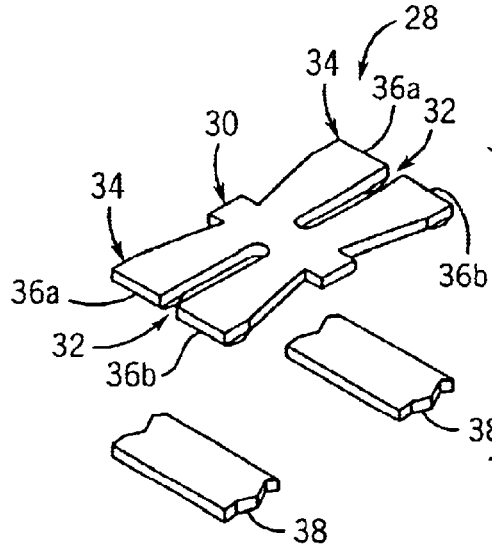
FIG. 2 (PRIOR ART)
FIG. 2 is a perspective view of another spanner portion of a control block constructed in accordance with conventional techniques.
Figure 4:
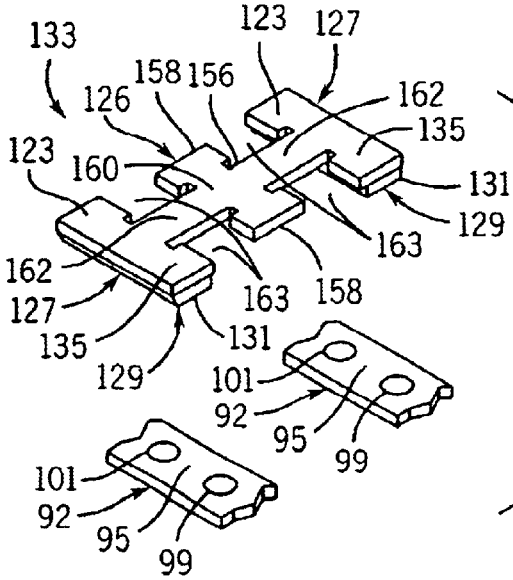
FIG. 4 is a perspective view of the spanner portion of the contact block illustrated in FIG. 3.

Referring now to FIG. 4, switch 133 is configured to provide a redundant electrical contact, and furthermore to resist failure due to arcing at the interface between outer ends 127 and plates 93, as experienced in conventional switch assemblies. In particular, spanner 126 includes a central laterally extending beam 156 that defines opposing lateral outer ends 127. Each lateral end 127 has opposing transverse outer ends 135 and 123 that are vertically aligned with nubs 99 and 101, respectively. A pair of protrusions 158 extends transversely outwardly from a middle portion 160 of beam 156 to a location proximal walls 134. Protrusions 158 extend laterally between flanges so as to stabilize the position of spanner 126 and furthermore to provide guides for axial spanner translation in housing 130.

Beam 156 has a width (transverse thickness) at locations 162 between protrusions 158 and outer ends 127 that is less than the width of ends 127. Ends 127 are thus T-shaped with respect to the beam sections 162. Ends 127 extend further transversely outwardly than protrusions 158 such that the entire beam 156 has a reduced width with respect to outer ends 127. The beam structure, along with the fact that beam 156 is made of a flexible material, combine to enable beam 156 to provide torsional compliance during operation.

Figure 7:
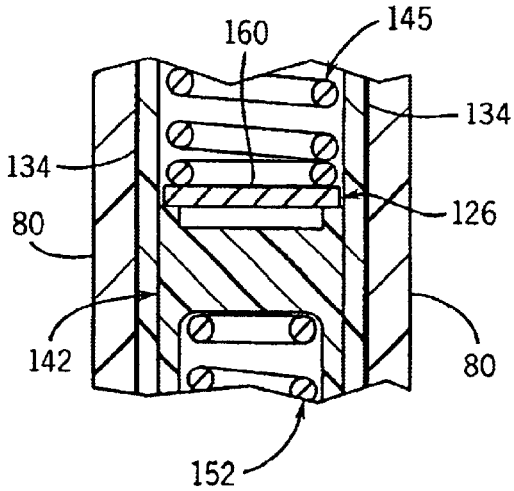
FIG. 7 is a sectional side elevation view of the contact block taken along line 7—7 of FIG. 6.
Figure 8:
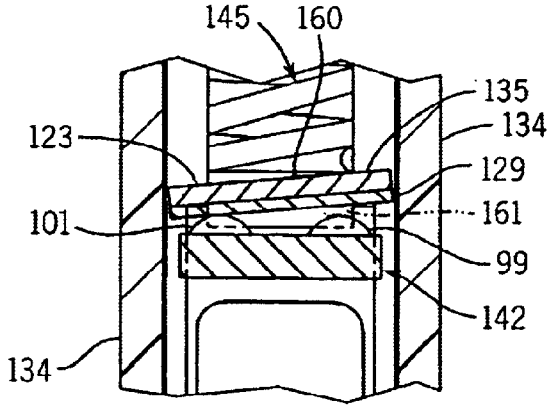
FIG. 8 is a sectional side elevation view of the contact block taken along line 8—8 of FIG. 6, wherein a nonconductive mass lodged between one of the contact locations.

Specifically, referring also to FIGS. 7 and 8, a nonconductive mass 161, such as a piece of dirt, lint, and the like, may become lodged between one of the nubs 99 and transverse outer end 135. Accordingly, electrical contact is unattainable between spanner 126 and nub 99. In prior non-torsionally compliant switches, the mass 161 would cause the adjacent transverse outer end 123 to a raised position above, and out of contact with, corresponding nub 101. In such devices, the switch would be unable to close, and control of the external device would be lost.

In accordance with the present invention, however, the portions 162 of spanner 126 have reduced transverse thicknesses relative to the corresponding lateral outer ends 127. Furthermore, spanner 126 is made of a compliant material and has a reduced axial thickness (within the range of 25 mm). Accordingly, when one transverse outer end 135 is raised with respect to corresponding nub 99, the force of upper spring 145 acting on the middle portion 160 of spanner 126 is translated to the other transverse outer end 123 so as to bias end 123 against the corresponding nub 101. Redundant contacts are thus established at each lateral outer end 127 between transverse outer ends 135 and 123, and nubs 99 and 101, respectively. Nonconductive mass 161 furthermore does not affect the ability of the opposite outer end 127 of spanner 126 to contact corresponding nubs 99 and 101.

When switch 133 is again opened, one of the transverse outer ends 123 or 135 will, if only for a minute period of time, become disengaged from the corresponding nub prior to the other transverse outer end. For instance, outer end 135 may become disengaged from nub 99 prior to outer end 123 becoming disengaged from nub 101. An arc may thus form at the interface between the remaining end 123 and nub 101. Transverse outer ends 135 and 123 are not bifurcated, however, meaning that lateral outer end 127 is a solid member that includes both transverse outer ends. Accordingly, even though an arc may be produced at outer end 123 when the switch 133 is opened, the increased thermal mass of lateral outer end 127 enables spanner 126 to absorb the arc while maintaining its structural integrity.

The redundancy of bifurcation in conventional spanners is thus replaced by the redundancy of torsional compliance in accordance with the preferred embodiment of the present invention. The lack of bifurcation allows the total mass of the spanner to participate in the opening and closing of the circuit hence reducing the detrimental thermal effects of the arc. This increases contact life and prevents contact welding. Thus, spanner 126 affords the same contact reliability of a bifurcated spanner while increasing structural reliability in the face of arcing during use.

As discussed above, sections 162 have a reduced width compared to the width of outer ends 127, and further have a reduced width compared to the width of middle portion 160. The reduced width of sections 162 is achieved by forming a corresponding pair of notches 163 between outer ends 127 and middle portion 160. Advantageously, notches 163 ensure that heat that accumulates at outer ends 127 thus has a reduced path of conductivity via sections 162. The middle portion 160 thus does not become heated as rapidly as conventional spanners, thereby further reducing potentially damaging thermal effects on nearby plastic parts.

Figure 9:
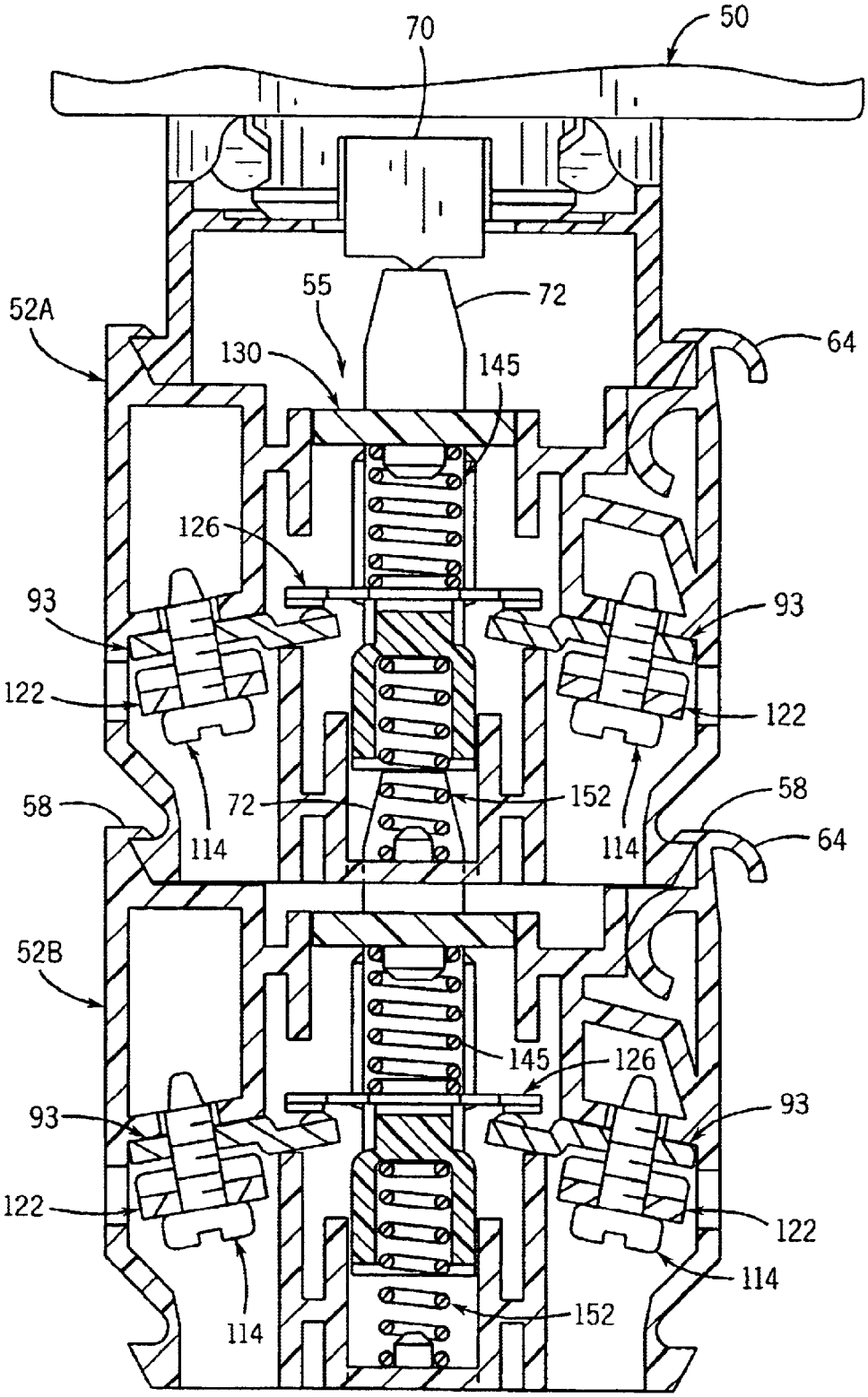
FIG. 9 is a sectional side elevation view of a pair of contact blocks vertically stacked to operate in tandem.

Referring now to FIG. 9, an upper contact block 52A is in communication with a switch operator 54 as described above. In addition, a lower contact block 52B is connected to the lower end of upper contact block 52A. Specifically, each contact block housing 56 includes a pair of lower flanges 164 that flare laterally outwardly from the lower end of side walls 82 (see FIG. 5). Contact blocks 52 may be vertically stacked by connecting lower flanges 164 to upper flanges 58. Plunger 72 comprises a pair of fingers 73 (See FIG. 10) that are transversely displaced a greater distance than the transverse thickness of base 83. The plunger 72 of lower contact block 52B thus fits over the base 83 of upper contact block 52A so as to engage the lower end of walls 134 of upper contact block 52A. The vertically stacked contact blocks 52A and 52B act in tandem in response to actuation of a single pushbutton 66 to control multiple external devices, or multiple functions of a single external device.

Figure 10:
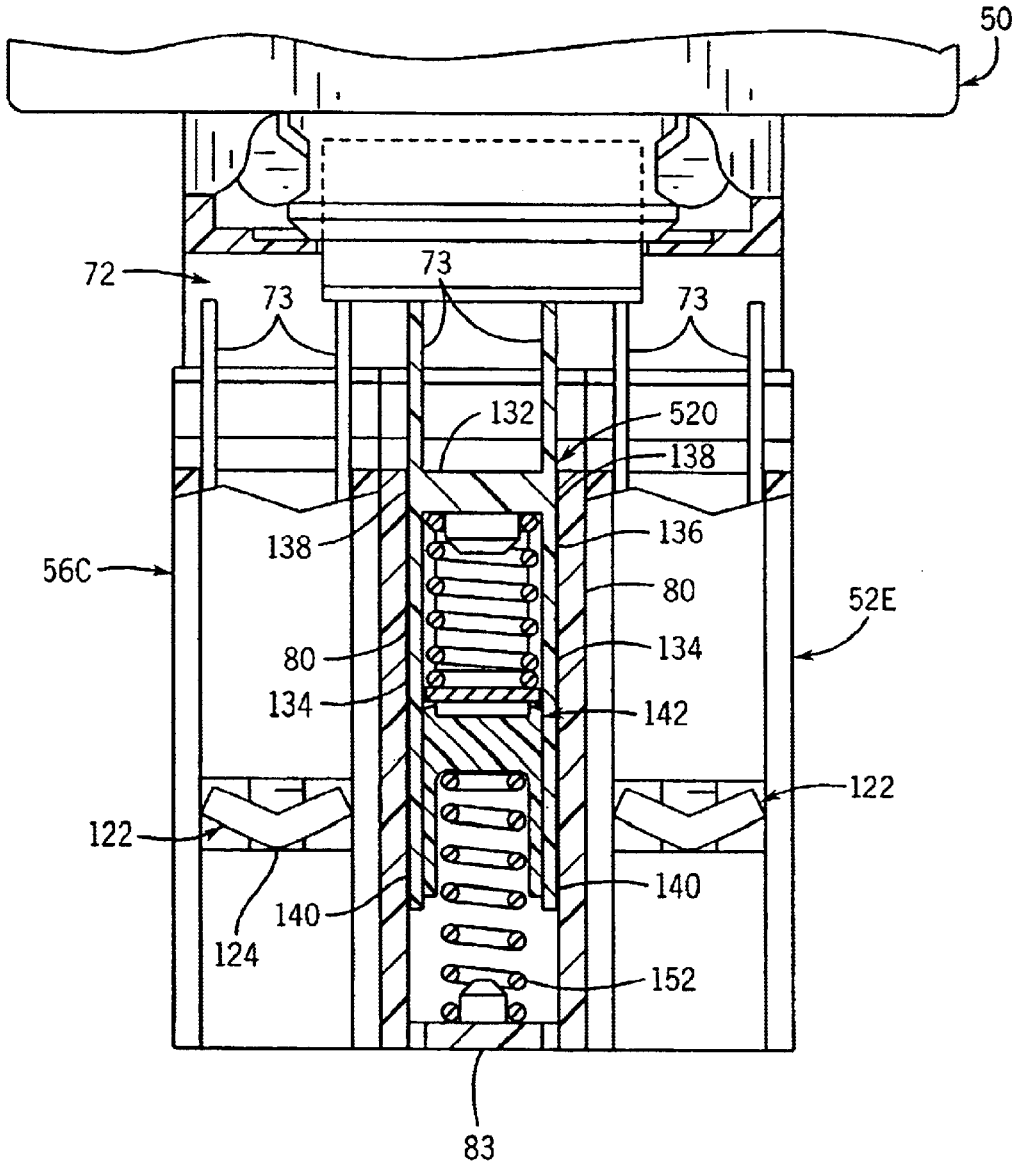
FIG. 10 is a sectional side elevation view of a plurality of contact blocks directly connected to a pushbutton to operate in tandem.

Referring now to FIG. 10, a plurality of contact blocks 52C, 52D, and 52E are mounted onto a single latch assembly 50 in a transverse orientation such that front and rear walls 80 of each contact block abut each other. Stem 70 extends transversely so as to engage both fingers 73 of plunger 72 of the middle contact block 52D along with one of the fingers of the outer contact blocks 52C and 52E. Accordingly, when pushbutton 66 is actuated, the plungers 72 of all three contact blocks 52C–52E are depressed. Pushbuttons 52A–52E may individually be normally open as described above, or normally closed as appreciated by one having ordinary skill in the art.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

We claim:

1. A switch of the type configured for installation in a contact block engaging an operator via a latch assembly, the switch comprising:

a conducting member defining a first and second end, wherein the first end is configured for electrical connection to an external device controlled by the switch, first and second conducting nubs extending outwardly from the second end; and a laterally extending conductive spanner having a body connected to an outer end aligned with the first and second conducting nubs of the second end of the conducting member;

wherein a circuit is formed when the spanner is electrically connected to the second end;

wherein the outer end of the spanner is solid and wider than the central body so as to render the spanner torsionally compliant.

2. The switch as recited in claim 1, wherein the spanner is normally biased away from the nubs via a spring force, and wherein the operator is engaged to bias the spanner to an engaged position with respect to the nubs.

3. The switch as recited in claim 1, wherein the spanner is normally engaged with the nubs via a spring force, and wherein the operator is engaged to bias the spanner to an disengaged position with respect to the nubs.

4. The switch as recited in claim 1, wherein the outer end extends between the first and second nubs without being bifurcated.

5. The switch as recited in claim 1, wherein the spanner comprises copper.

6. The switch as recited in claim 1, wherein the outer ends of the spanner are coated with a conductive material.

7. The switch as recited in claim 6, wherein the conductive material comprises silver.

8. The switch as recited in claim 1, further comprising:

a second conducting member defining a first and second end; and a first and second nub extending outwardly from the second end of the second conducting member;

wherein the laterally extending conductive spanner comprises a second outer end such that the body is disposed between the outer ends of the spanner, the second outer end aligned with the first and second nubs of the second end of the second conducting member.

9. The switch as recited in claim 8, wherein both outer ends of the spanner are wider than the central body so as to render the spanner torsionally compliant.

10. A switch assembly for controlling an external device, the switch assembly comprising;

an operator;

a contact block in mechanical communication with the operator, the contact block including:

i. a conducting member having a first end and a second end, wherein the first end is configured for electrical connection to the external device, ii. first and second conducting nubs extending outwardly from the second end; and iii. a conductive spanner having a body connected to an outer end that is aligned with the second end of the contact so as to engage both the first and second nubs when the switch assembly is closed, wherein the outer end is a solid unitary body, wherein a circuit is formed with the external device when the outer end of the spanner is electrically connected to the second end of the conducting member.

11. The switch assembly as recited in claim 10, wherein the spanner is normally open with respect to the contact.

12. The switch assembly as recited in claim 10, wherein the spanner is normally closed with respect to the contact.

13. The switch assembly as recited in claim 10, wherein the body of the conductive spanner has a width less than the outer end.

14. The switch assembly as recited in claim 10, wherein the contact block is a first contact block, further comprising a second contact block connected to the first contact block such that actuation of the switch assembly of the first contact block further actuates a switch assembly of the second contact block.

15. The switch assembly as recited in claim 10, wherein the contact block is in mechanical communication with the operator via a latch assembly.

16. The switch assembly as recited in claim 15, further comprising a plurality of contact blocks connected to the latch assembly and directly engaged by the operator.

17. The switch assembly as recited in claim 10, wherein the solid unitary body of the outer end absorbs an arc that is created when the spanner becomes disengaged from at least one of the corresponding nubs.

18. The switch assembly as recited in claim 8, wherein the spanner body defines a middle portion displaced from the outer end by a notch formed in the body.

19. The switch as recited in claim 10, further comprising:

a second conducting member defining a first and second end; and a first and second nub extending outwardly from the second end of the second conducting;

wherein the laterally extending conductive spanner comprises a second outer end such that the body is disposed between the outer ends of the spanner, the second outer end aligned with the first and second nubs of the second end of the second conducting member.

20. The switch as recited in claim 19, wherein both outer ends of the spanner are wider than the body so as to render the spanner torsionally compliant.

* * * * *

UNITED STATES PATENT AND TRADEMARK OFFICE

CERTIFICATE OF CORRECTION

PATENT NO. : 6,987,235 B2 
DATED : January 17, 2006
INVENTOR(S) : Homer S. Sambar et al.

It is certified that error appears in the above-identified patent and that said Letters Patent is hereby corrected as shown below:

Title page,
Item [56], References Cited, FOREIGN PATENT DOCUMENTS, change "1 204 398" to -- 1 204 396 --.

Signed and Sealed this

Eleventh Day of April, 2006

JON W. DUDAS
*Director of the United States Patent and Trademark Office*